US005423371A

United States Patent [19]

Landua et al.

[11] Patent Number: 5,423,371

[45] Date of Patent: Jun. 13, 1995

[54] METHOD OF AND APPARATUS FOR SCREWING TOGETHER PARTS WITH LITTLE STRENGTH

[75] Inventors: Werner Landua, Mannheim; Reiner Rommel, Brühl; Walter Rauscher, Mannheim, all of Germany

[73] Assignee: Adolf Hottinger Maschinenbau GmbH, Mannheim, Germany

[21] Appl. No.: 144,726

[22] Filed: Oct. 28, 1993

Related U.S. Application Data

[63] Continuation of Ser. No. 768,735, Oct. 10, 1991, abandoned.

[30] Foreign Application Priority Data

Apr. 10, 1989 [DE] Germany ..... 39 11 635.2
Feb. 16, 1990 [DE] Germany ..... 40 04 903.5

[51] Int. Cl.[6] ..... B22C 9/10; B23P 19/06

[52] U.S. Cl. ..... 164/137; 29/525.1; 81/54

[58] Field of Search ..... 164/137, 339; 81/54; 29/525.1

[56] References Cited

U.S. PATENT DOCUMENTS 4,058,884 11/1977 Lydon et al. ..... 29/525.1
4,199,014 4/1980 Nickle ..... 29/525.1 X
4,777,851 10/1988 Gubitose ..... 29/525.1 X

FOREIGN PATENT DOCUMENTS 2597776 10/1987 France .
2522161 11/1976 Germany .
2549601 5/1977 Germany .
3424911 1/1986 Germany .
53-44426 4/1978 Japan ..... 164/137
60-221227 11/1985 Japan .
63-34031 2/1988 Japan .

OTHER PUBLICATIONS

Abstract of Japanese Patent Publication 57-84686 Published May 27, 1982.

*Primary Examiner*—J. Reed Batten, Jr.
*Attorney, Agent, or Firm*—Bell, Seltzer, Park & Gibson

[57] ABSTRACT

The apparatus includes a gripping device (3) for picking up the parts (1, 2) to be joined and at least one screwdriver (6) comprising a screw spindle (10) and a drive (11) for the screw spindle. The screw spindle (10) is resiliently mounted for movement in the direction of the screw feed and it may be laterally adjusted in each of two perpendicular directions so as to permit an accurate alignment of the screw with the parts to be joined.

11 Claims, 6 Drawing Sheets

2
5
2
1
1
3
5
20
20
15
15
16
19
16
17
10
17
4
8
15

METHOD OF AND APPARATUS FOR SCREWING TOGETHER PARTS WITH LITTLE STRENGTH

This application is a continuation, of application Ser. No. 07/768,735, filed Oct. 10, 1991, and now abandoned.

BACKGROUND OF THE INVENTION

The invention relates to an apparatus for screwing together parts with little strength, in particular an apparatus for joining shells, molds, foundry cores, preferably bottom cores and water-jacketed cores, as well as a corresponding method.

The joining of parts with little strength is always a problem, since a complicated handling or a costly transportation of such parts to a screwing station can lead already to a breakage of these parts. To avoid a breakage of the parts to be joined, it is also necessary to provide for both a fine feed and a slight tightening torque of the screw.

Cores as are employed in the foundry practice, are such parts with little strength, so that the problems arising in the practice will be described below with reference to such cores.

In the foundry practice, cores are formed by hand or with the aid of core molding machines in special, multipart core boxes or core dies. In general, the cores are manufactured by blowing, plugging and shooting. The individual cores are assembled or joined in separate operations by bonding or nailing. As a result, the method of manufacture is very complicated, labor-intensive and time-consuming (German Patent DE 35 26 265 and German Utility Model GM 75 15 919).

Further it has been found in practice when joining parts with little strength or when assembling individual cores by nailing or screwing that the material of the parts to be joined breaks easily as a result of shearing forces which occur in this process.

SUMMARY OF THE INVENTION

It is therefore the object of the present invention to first provide for an apparatus for joining parts with little strength, in particular for joining shells, molds and foundry cores, preferably bottom cores and water-jacketed cores, which allows to bring the parts to be joined, without any intermediate handling, directly from the manufacturing station to the screwing station. In so doing, it is intended to reduce considerably the risk of damage to the parts to be joined or even of breakage of the material. Furthermore, it is the object to provide for a corresponding method.

According to the invention, the foregoing problem is solved by providing a gripping device for gripping the parts to be joined and at least one screw driver comprising a screw spindle and a drive means for the screw spindle. In a particularly advantageous manner, the screw spindle is spring mounted at least in the direction of the screw feed.

It has been recognized, first, that a proper screwing together of the parts concerned requires a gripping device for gripping the parts to be screwed together and at least one screw driver comprising a screw spindle and a drive means therefor. It has further been recognized that the damage to the material or the breakages of the material which frequently occur when parts with little strength are screwed together, is primarily due to a too "coarse" screw feed. According to the invention, this "coarse" screw feed is reduced by a resilient support of the screw spindle at least in the direction of the screw feed, when the screw meets with a resistance on the side of the material.

In a particularly advantageous manner, a spring housing is arranged between the drive means of the screw spindle and the screw spindle to provide for a resilient support of the latter. This spring housing accommodates at least one spring element which is operative between the drive means and the screw spindle.

For purposes of balancing the feed differences between the advance of the screw spindle and the screw insertion speed which is defined by both the speed and the thread pitch of the screw to be driven in, without adversely affecting the contact pressure of the screw spindle on the screw and thus on the material of the parts to be screwed together, a driving pin is provided in a further advantageous manner, which is arranged on the spring element, and, thus, represents a connecting member or an operative connection between the spring element and the screw.

Furthermore, it has been recognized that besides a "coarse" screw feed, a too high tightening torque can lead likewise to a breakage of material in parts with little strength. It was therefore necessary to reduce the tightening torque, so as to avoid a breakage of the material, in such a manner, that tolerance ranges are no longer possible. It would be possible, though, to hold the screws by clamping jaws when they are injected automatically by means of compressed air, in which event the clamping jaws could apply the holding pressure, for example, via leaf springs. However, in so doing, the tightening torque would be considerably influenced when the screw head is pushed through the clamping jaws and against the holding pressure of the leaf springs, so that it would become impossible to maintain any longer the uniform tightening torque which is necessary to apply to the screw.

With respect to a limitation of the tightening torque, it is therefore of special advantage that the torque of the drive means or respectively the screw driver is defined by a preferably adjustable, automatic cut-off clutch which is provided in the drive means.

When the screws are injected automatically, clamping jaws are provided for holding the screws. The holding pressure is generated by means of pneumatic or hydraulic cylinder-piston arrangements. The clamping jaws open for the passage of the screws.

However, it happens specifically when parts with little strength, in particular brittle parts are joined, that particles separate when the screw is driven in, which subsequently penetrate into the region of the clamping jaws and increase there the frictional values, or even result in damage to the jaws. Therefore, in a further embodiment of the teaching of the present invention, the particles of the parts to be screwed together, which enter during the screwing into the region of the apparatus, are blown out or sucked off by means of a blower.

For purposes of being able to insert in a proper manner, with the apparatus of the present invention, also screws which are not in alignment with the original axis of the screw spindle, the screw spindle is resiliently supported in a further advantageous manner also in transverse direction to the direction of the screw feed. Thus, a small clearance of the screw is created orthogonally to the direction of the screw feed, which permits the screw spindle to tilt slightly.

As regards the preparation of the screws to be driven in, and having particularly in mind an automatic joining of the parts concerned, an injector is provided which feeds the screws to be entered by the screw driver. For purposes of ensuring a troublefree advance of the individual screws to the screw spindle or respectively to the parts to be screwed together, the injector is provided with a reflected light barrier for monitoring and controlling these operations.

Finally, the screw drivers can be changed in their position by means of spindles, whereby the screw drivers are adjusted to different screw-inserting positions.

By the method of joining parts with little strength, in particular of joining shells, molds, foundry cores, preferably bottom cores and water-jacketed cores, as is provided by the present invention, the parts to be joined are first picked up by means of a gripping device and jointly stayed. Then, the parts are positioned in the working range of a screw driver. In the case of screwing together foundry cores, the parts or respectively cores are positioned in an orderly fashion above one or several screw drivers. Subsequently, one or several screws are injected into the screw driver. The parts are screwed together, with a resilient support of the screw spindle balancing the screw feed, i.e., the screw insertion speed, in a particularly advantageous manner for the purpose of avoiding damage to the parts or avoiding a brittle fracture, and without adversely affecting the contact pressure.

For the purpose of avoiding damage to the parts to be joined, the operation of driving in the screw is further made advantageous in such a manner that the torque of the screw driver is defined or respectively controlled by a preferably adjustable, automatic cutoff clutch.

There are various other possibilities of configuring and further developing the teaching of the present invention in an advantageous manner. To this end, it should be referred, first, to the subsequent claims and, second, to the following description of an embodiment of the invention with reference to the drawing.

BRIEF DESCRIPTION OF THE DRAWINGS

Some objects and advantages of the present invention having been stated, others will appear when considered in conjunction with the accompanying drawings, in which FIG. 1 a schematic side view of an embodiment of the apparatus according to the present invention.

DETAILED DESCRIPTION OF THE PREFERRED EMBODIMENT

Figure 1:
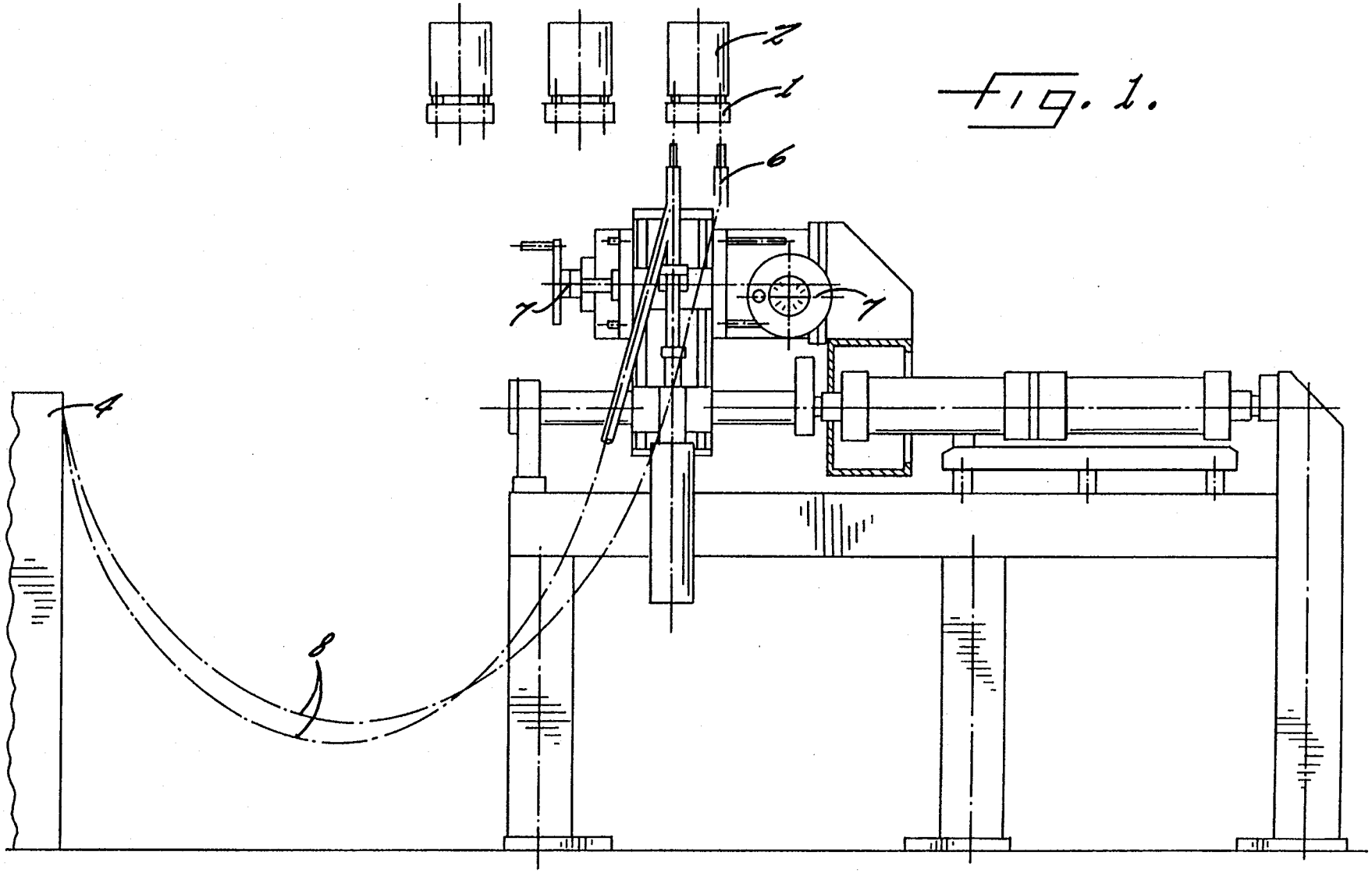
Figure 2:
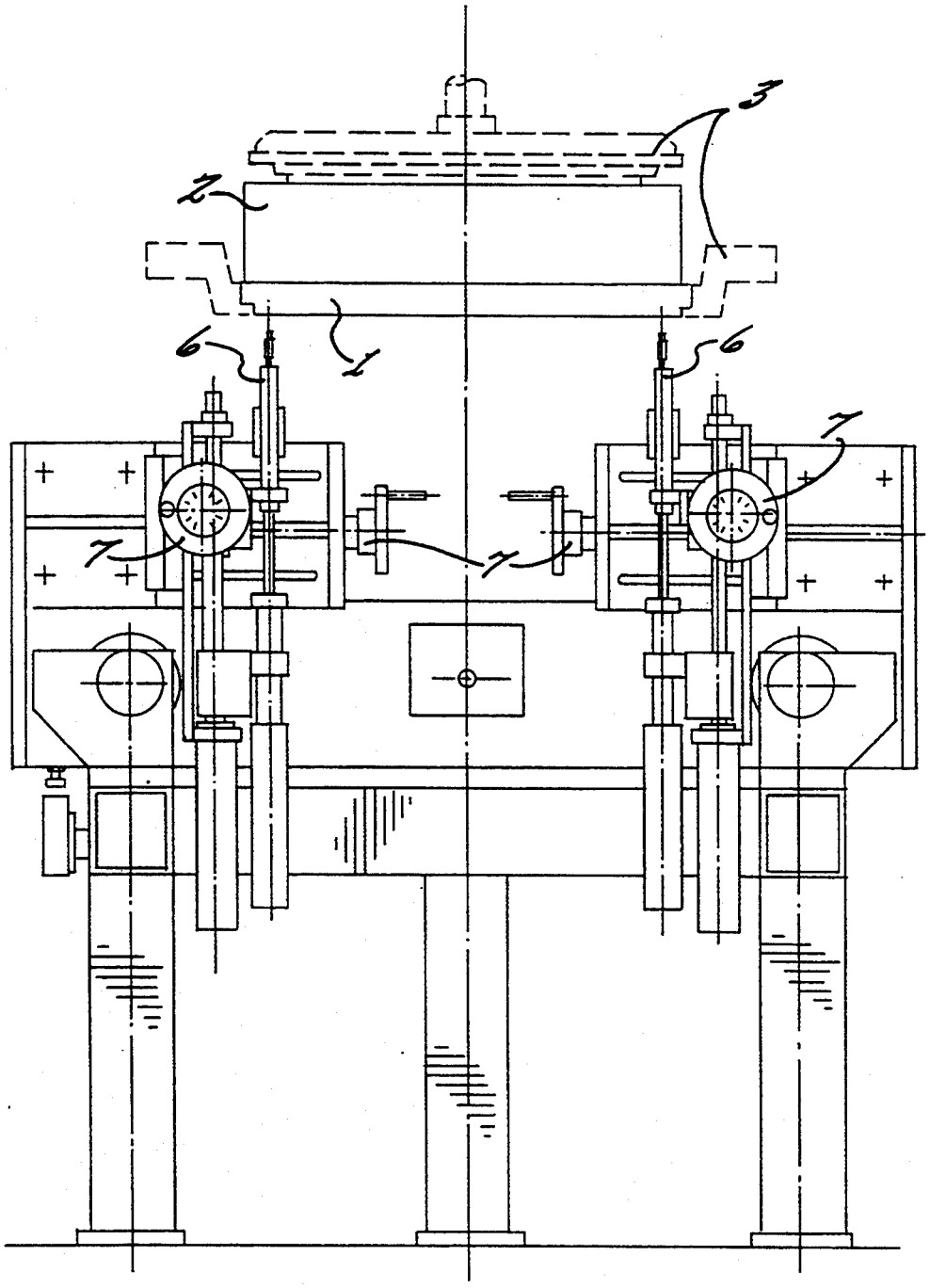
FIG. 2 a schematic front view of the apparatus of FIG. 1.
Figure 3:
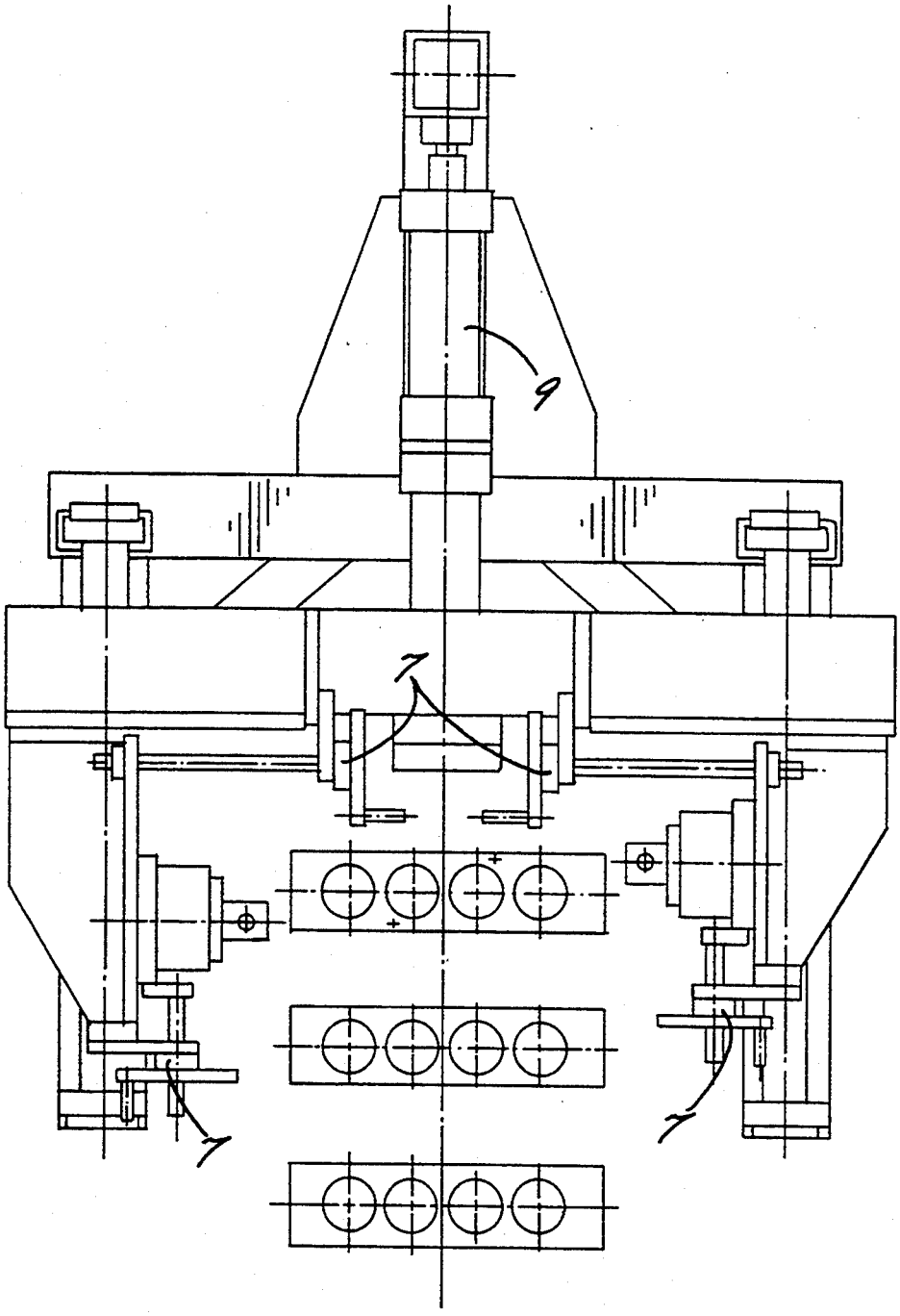
FIG. 3 a schematic top view of the apparatus of FIG. 1.

FIGS. 1–3, 5 and 6 illustrate an embodiment of an apparatus of the present invention for screwing together parts 1, 2, with little strength. The apparatus is a screwing device for screwing together foundry cores, namely bottom cores and water-jacketed cores 1, 2.

The apparatus of the present invention includes a gripping device 3 for picking up the foundry cores 1, 2 which are to be screwed together, and a screw driver 6 comprising a screw spindle 10 and a drive means 11 for the screw spindle 10.

Figure 6A:
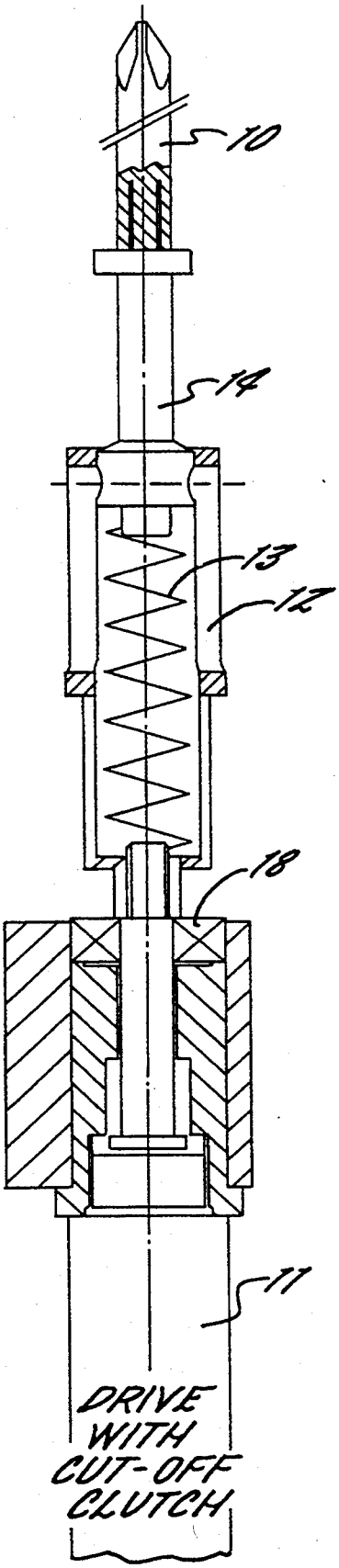
FIG. 6A is a view similar to FIG. 6 but sectioned and rotated 90°.
Figure 6:
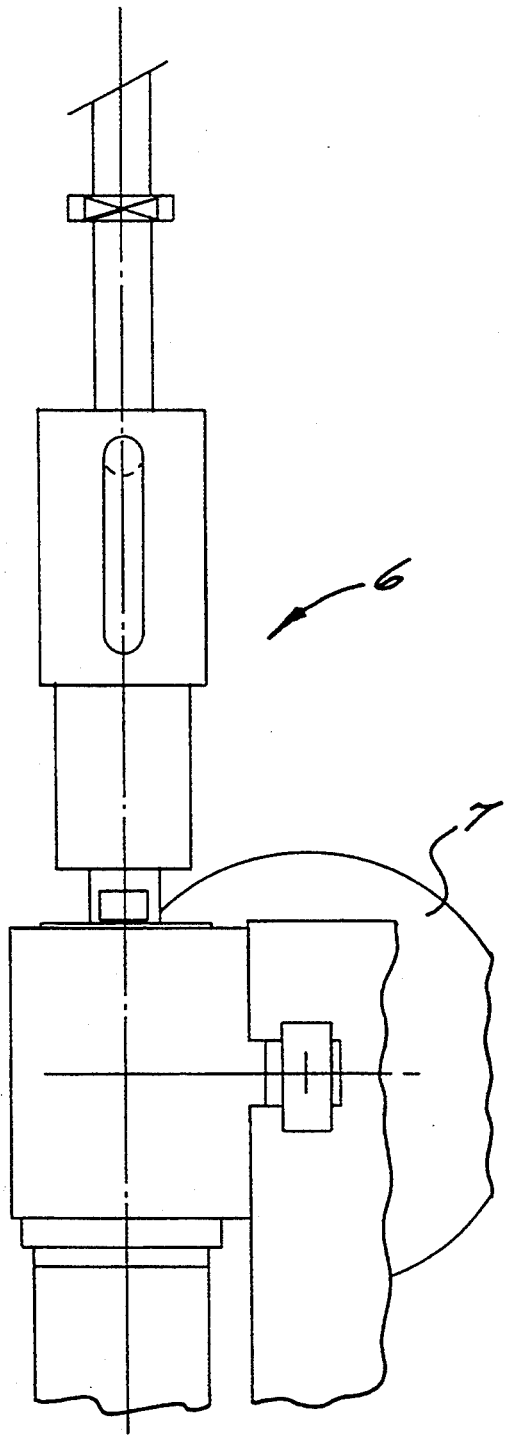
FIG. 6 an axial schematic view of a screw driver of the apparatus of FIG. 5.

As shown in the illustrations of FIGS. 6, and 6A the screw spindle 10 is spring mounted at least in the direction of the screw feed. As can be noted, this is accomplished in that a spring housing 12 with a spring element 13 which is operative between the drive means 11 and the screw spindle 10, is arranged between the drive means 11 of the screw spindle 10 and the screw spindle 10 for a resilient support of the latter. Arranged on the spring element 13 is a driving pin 14.

Furthermore, the torque of the drive means 11 or respectively the screw driver 6 is defined by an adjustable, automatic cutoff clutch provided in the drive means 11.

For holding the screws 5 when they are automatically injected, clamping jaws 15 are provided. The necessary holding pressure is generated by means of pneumatic or hydraulic cylinder-piston arrangements 16. The clamping jaws 15 open only for the passage of the screws 5.

Figures 5, 5A:
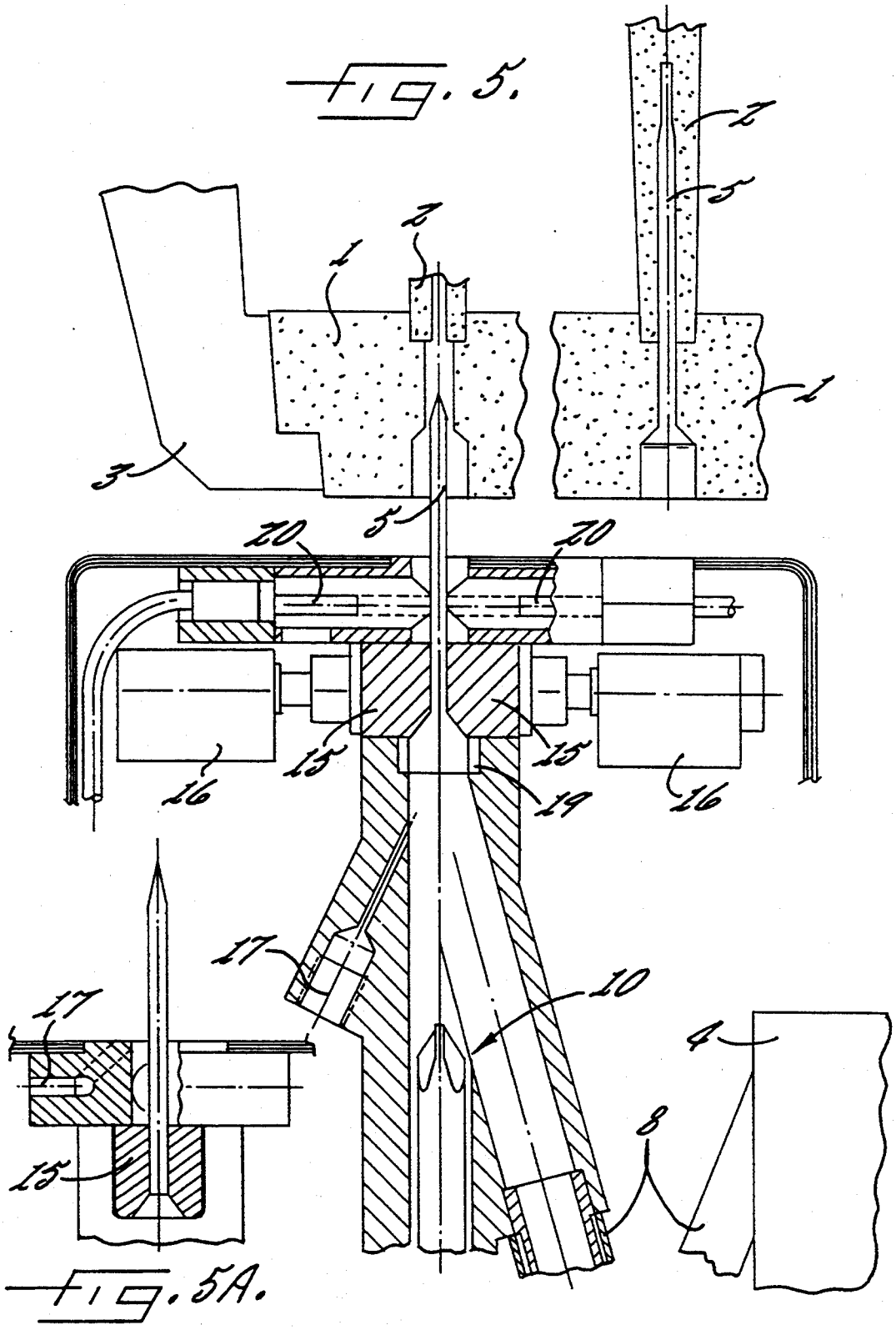
FIG. 5 a longitudinal sectional view, partially enlarged, of the apparatus according to the present invention.
FIG. 5A is a fragmentary sectional view illustrating the screw clamping jaws and the air blowing means of the invention.

Particles of the parts 1, 2, which may enter into the region of the apparatus during the screwing operation, are removed by means of a blower 17 or via a suction device as illustrated in FIGS. 5 and 5A.

Figure 4:
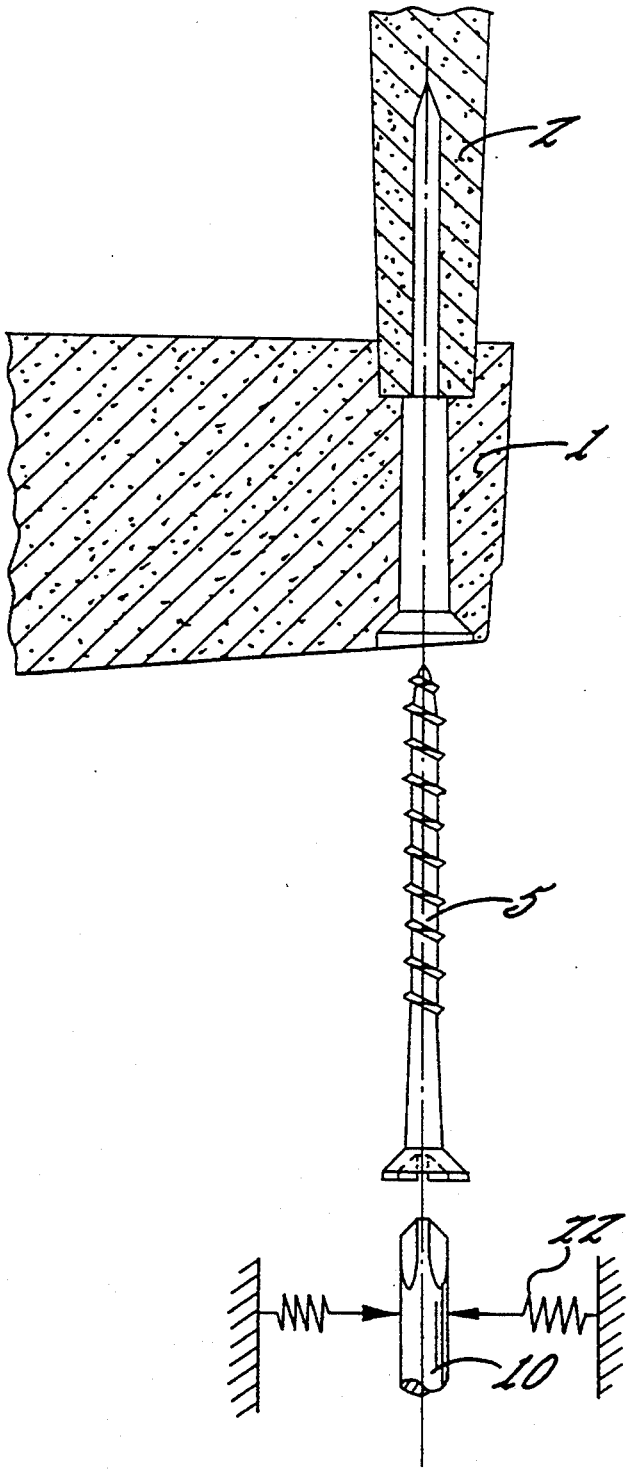
FIG. 4 an enlarged exploded view of the parts to be screwed together, the screw driver and the screw.

As shown schematically at 22 in FIG. 4, the screw spindle 10 can also be spring mounted transversely to the direction of the screw feed, so that it will be easy to also drive in screws 5 which are not in alignment with the original axis of the screw spindle 10.

Indicated at 4 in FIGS. 1 and 5 is an injector for feeding the screws 5 to be driven in by the screw driver 6. The injector 4 can also be provided with a device for singling the screws 5, which is not shown in the figures. Also, the apparatus preferably includes a reflected light sensor 20 for monitoring and controlling the feed of the screws 5.

The operation of the apparatus according to the present invention is as follows: The parts 1, 2 or respectively the bottom core 1 and the water-jacketed core 2 are assembled or joined, picked up by the gripping device 3, and jointly stayed. Subsequently, the stayed parts 1, 2 are moved above the screw driver 6. A screw 5 or screws 5 are pneumatically fed by means of the injector 4 through feed hoses 8 into the clamping jaws 15. The parts 1, 2 are then screwed together. The respective screwing position of the spindle 10 can be preset via an adjusting spindle 7. The screw spindles 10 with drive motor 11, spring housing 12, spring 13, and driving pin 14 serve to gently screw together parts 1, 2, with the screw feed or respectively the screw inserting speed being balanced, without adversely affecting the contact pressure which the screw spindle 10 exerts on the screw 5. The screws are held by the clamping jaws 15 which are actuated via a pneumatic cylinder 16. Only for the purpose of a complete illustration, ball bearings and a bearing sleeve are indicated at numerals 18, 19.

Finally, it should here be emphasized one more time that the teaching of the present invention is concerned with the joining of parts having little strength. The screwing together of foundry cores is here brought up only as an example.

That which is claimed is:

1. A method of joining parts having little strength and which are easily broken, and comprising the steps of supporting the parts in the relationship in which they are to be joined, providing screw driver means for rotatably driving a screw into the supported parts to join the parts together and including a screw spindle defining a drive axis and having an outer end configured to engage the screw to effect rotation thereof, drive means for rotating said screw spindle about its drive axis, and spring biasing means for permitting limited movement of the screw spindle in an axial direction away from the screw being driven and while said screw spindle is being rotated by said drive means, adjustably positioning the screw driver means in each of only two lateral directions which are perpendicular to each other so as to permit an accurate alignment of the drive axis with the supported parts, advancing a screw to a ready position which is located between the supported parts to be joined and said screw spindle, engaging the thus positioned screw with the outer end of said screw spindle, and then operating the drive means to rotate the screw spindle as well as the engaged screw and so as to advance the screw into the supported parts and join the parts together.

2. The method as defined in claim 1 wherein the step of operating the drive means includes releasing the driving torque upon the driving torque exceeding a predetermined upper limit.

3. An apparatus for joining parts having little strength and which are easily broken, and comprising gripping means for supporting the parts in the relationship in which they are to be joined, screw driver means for rotatably driving a screw into the supported parts to join the parts together and including a screw spindle defining a drive axis and having an outer end configured to engage the screw to effect rotation thereof, drive means for rotating said screw spindle about its drive axis, and spring biasing means for permitting limited movement of the screw spindle in an axial direction away from the screw being driven and while said screw spindle is being rotated by said drive means, and means mounting said screw driver means adjacent said gripping means and so as to permit adjustment of its position laterally with respect to said drive axis of said screw spindle, said mounting means including means for effecting selective movement of said screw driver means in each of only two lateral directions which are perpendicular to each other.

4. The apparatus as defined in claim 3 wherein said spring biasing means is mounted between said screw spindle and said drive means.

5. The apparatus as defined in claim 4 wherein said spring biasing means comprises a coiled compression spring.

6. The apparatus as defined in claim 3 wherein said drive means includes clutch means for automatically releasing its driving torque upon the driving torque reaching a predetermined upper limit.

7. The apparatus as defined in claim 3 wherein said screw driver means further includes means for automatically positioning a screw in a ready position which is located between the supported parts to be joined and said screw spindle, and such that said screw spindle is adapted to engage the thus positioned screw and rotatably drive the same into the supported parts.

8. The apparatus as defined in claim 7 wherein said screw driver means further includes sensor means for detecting the presence of a screw at said ready position.

9. The apparatus as defined in claim 7 wherein said screw driver means further includes clamping jaw means for releasably supporting a screw in said ready position, and with said clamping jaw means comprising a pair of opposing jaws and means for biasing said jaws toward each other.

10. The apparatus as defined in claim 9 wherein said screw driver means further includes air blowing means for engaging any particles released from the parts being joined together and removing such particles from the vicinity of said screw driver means.

11. The apparatus as defined in claim 7 further comprising means resiliently mounting said screw spindle so as to permit limited lateral movement thereof with respect to said drive axis and thereby permit the screw spindle to align itself with a screw at said ready position.

* * * * *